US005092238A

United States Patent [19]

Philpot

[11] Patent Number: 5,092,238

[45] Date of Patent: Mar. 3, 1992

[54] PRINTING PLATE COMPOSITE INCLUDING A QUICK MOUNTING SYSTEM FOR SECURING SUCH COMPOSITE TO A PRINTING PLATE CYLINDER

[75] Inventor: Ivan N. Philpot, Irving, Tex.

[73] Assignee: Matthews International Inc., Pittsburgh, Pa.

[21] Appl. No.: 586,272

[22] Filed: Sep. 21, 1990

[51] Int. Cl.[5] ..... B41F 27/00

[52] U.S. Cl. ..... 101/415.1; 101/378

[58] Field of Search ..... 101/378, 382.1, 383, 101/384, 385, 386, 387, 388, 389, 415.1, 376, 485, 486

[56] References Cited

U.S. PATENT DOCUMENTS

| | | | |
|---|---|---|---|
| 2,704,025 | 3/1955 | Anderson et al. | 101/415.1 |
| 3,228,329 | 1/1966 | Mangus et al. | 101/378 |
| 3,295,443 | 1/1967 | Devon | 101/376 |
| 3,934,509 | 1/1976 | Saunders et al. | 101/415.1 |
| 4,047,481 | 9/1977 | Saunders | 101/376 |

FOREIGN PATENT DOCUMENTS

| | | | |
|---|---|---|---|
| 1213861 | 4/1966 | Fed. Rep. of Germany | 101/415.1 |

OTHER PUBLICATIONS

Rogers Corporation News Release.

*Primary Examiner*—Edgar S. Burr
*Assistant Examiner*—Ren Yan
*Attorney, Agent, or Firm*—Armstrong, Nikaido, Marmelstein, Kubovcik & Murray

[57] ABSTRACT

An improved compressible-type printing plate composite for use in a printing arrangement is provided by this invention. Such composite includes a substantially T-shaped member having each of a carrier sheet and a printing plate carrier sheet secured thereto. Disposed intermediate such carrier sheet and such printing plate carrier sheet is a sponge-like member which provides the requisite amount of compressibility to such composite. This sponge-like member is secured to one surface of the carrier sheet.

24 Claims, 1 Drawing Sheet

PRINTING PLATE COMPOSITE INCLUDING A QUICK MOUNTING SYSTEM FOR SECURING SUCH COMPOSITE TO A PRINTING PLATE CYLINDER

FIELD OF THE INVENTION

The present invention relates, in general, to printing arrangements used in printing on substrate materials used in the packaging industry and, more particularly, this invention relates to an improved printing plate composite having incorporated therein a mounting system which enables such printing plate composite to be quickly and easily secured to and removed from the working surface of a printing plate cylinder used in a printing arrangement.

BACKGROUND OF THE INVENTION

Over the past few years it has become the practice in the retail sales industry to utilize what is known in the packaging industry as "point of sales" packaging for the majority of products offered for sale. As would be expected, this practice has forced the packaging industry to develop and implement new equipment and operating practices, which would provide significant improvement in the quality of printing. In other words, the former "brown box" would no longer be acceptable.

Consequently, flexographic printing was introduced into the package printing industry and is now in widespread use. See, for example, an article published in the December, 1979, issue of Boxboard Containers, titled "It's Time For A Change In Flexo". As discussed in this article, flexographic printing entered this area of use in the 1960's when convertors begin installing the equipment necessary to initiate use of the flexographic printing process. The convertors could now print, slot, fold, glue, die-cut and bundle in a true production line manner with this new flexographic equipment.

In addition to all the advantages of the in-line operations, this change in equipment for flexography also offered the potential for extended capabilities and other improvements in package printing. However, those additional benefits were not immediately taken advantage of. For example, even with this new process and equipment, the convertors continued to use the same printing plate systems used prior to the introduction of the flexographic printing system. The printing plate system consisted of a rather thick rubber plate secured to a fabric which in turn was secured to a carrier material.

A significant change in the printing plate system used, occurred in the late 1970's and early 1980's when the Rogers Corporation introduced the use of a cellular polyurethane material as a backing for flexible printing plates. In this system, the flexible printing plates are secured directly to the polyurethane material which, in turn, is glued to the printing plate cylinder using either an adhesive film or "sticky back" tape. In some cases, the polyurethane material is adhered to and supported on a polyester backing material. In either case, the printing plate is secured directly to the upper surface of such polyurethane material.

Because the printing plate system is essentially glued on the working surface of the printing plate cylinder great care must be exercised in mounting such printing plate system to such working surface to ensure proper alignment.

It is also known in the prior art to use a substantially T-shaped member to align and secure one end of a printing plate composite to a bar-like member disposed on such working surface of the printing plate cylinder and substantially parallel to the longitudinal axis thereof. In this case, the printing plate is disposed on a vinyl-like sheet, which in turn, is engaged with the working surface of the printing plate cylinder. The T-shaped member is secured to one end of the sheet and the axially opposed other end of the sheet is secured to the printing plate cylinder with tape or strap-like members. This fastening system for the printing plate is commonly known in the industry as the Matthews Fast-Loc. Use of this system results in less downtime of the press being required to achieve proper alignment of the printing plate on the working surface of the printing plate cylinder.

Although each of the above-discussed improved printing plate systems have greatly advanced the printing of substrate materials used in the packaging industry, they also each have certain limitations in their use. For example, the Roger's printing plate system requires a considerable amount of time to set up in the press even though it enables poorer quality substrate material to be used and is not as sensitive to slight imperfections, which may be present, in the working surface of the printing plate cylinder. On the other hand, the Matthews Fast-Loc printing plate system can be set up very quickly on the press, although it requires higher quality substrate material and fewer imperfections in the working surface of such printing plate cylinder.

SUMMARY OF THE INVENTION

The present invention provides an improved compressible-type printing plate composite. Such printing plate composite includes both a quick mounting and a quick alignment system incorporated therein. This system enables such printing plate composite to be quickly secured in place on at least a predetermined portion of a working surface of a printing plate cylinder in an accurately pre-aligned position. Such cylinder is positioned in at least one print station disposed in a printing arrangement. Such compressible-type printing plate composite includes, according to this invention, an elongated substantially T-shaped member. This substantially T-shaped member includes a first elongated flat strip-like portion having first and second axially opposed edges, first and second axially opposed surfaces and first and second axially opposed ends. This first flat strip-like member further has a first predetermined length, a first predetermined width and a first predetermined thickness. Such substantially T-shaped member further has a second elongated flat strip-like member having axially opposed first and second edges, axially opposed first and second surfaces and axially opposed first and second ends. In addition, such second flat strip-like member has a second predetermined length, a second predetermined width and a second predetermined thickness. This second flat strip-like member is connected, along substantially an entire length thereof, substantially normal to such first edge of the first flat strip-like portion. Such connection occurs substantially midway between the axially opposed first and second edges on such first surface of the second flat strip-like portion. Such first flat strip-like portion and such second flat strip-like portion forming a T-shaped member.

Another part of such substantially T-shaped member is a third elongated flat strip-like portion which has axially opposed first and second edges, axially opposed first and second surfaces and axially opposed ends. This third flat strip-like member has a third predetermined length, a third predetermined width and a third predetermined thickness. Such third flat strip-like portion is connected, substantially along an entire length of the first edge thereof, to such first edge of the second flat strip-like portion. The second edge of such third flat strip-like portion extends toward the second edge of such first flat strip-like portion. The first surface of this third flat strip-like portion is positioned such that it is substantially parallel to and facing such first surface of the first flat strip-like portion. The third flat strip-like portion forms a first hook-like portion of the substantially T-shaped member which both quickly engages and quickly aligns the printing plate composite with a bar-like member located adjacent the working surface of such printing plate cylinder. This bar-like member is disposed substantially parallel to the longitudinal axis of such printing plate cylinder. The final part of this substantially T-shaped member is a fourth elongated flat-strip-like portion having first and second axially opposed edges, first and second axially opposed surfaces and first and second ends. This fourth flat strip-like portion being connected, substantially along the entire length of such first edge thereof, to such second edge of such second flat strip-like portion. The second edge of this fourth strip-like portion also extends toward the second edge of the first strip-like portion like the second edge of such third flat strip-like portion. The first surface of such fourth flat strip-like portion is positioned such that it is substantially parallel to and facing the second surface of such first flat strip-like portion. This fourth strip-like portion has a fourth predetermined length, a fourth predetermined width and a fourth predetermined thickness. It is evident from the above description that in combination, such first flat strip-like portion, such second flat strip-like portion, such third flat strip-like portion and such fourth strip-like portion form a substantially T-shaped member of the printing plate composite. This improved printing plate composite further includes a carrier sheet having a predetermined length and a predetermined thickness. Such carrier sheet includes an outer surface, at least a portion of which is engageable with the working surface of such printing plate cylinder. Further, the improved printing plate composite includes a sponge-like member having a predetermined length and a predetermined width and a predetermined thickness. A first surface of this sponge-like member is both engageable with and secured to an axially opposed inner surface of the carrier sheet. Such sponge-like member providing the improved printing plate composite with a least a portion of the requisite amount of compressibility desired. Another component of the improved printing plate composite is a printing plate carrier sheet. Such printing plate carrier sheet having a predetermined length, a predetermined width and a predetermined thickness. A first surface of such printing plate carrier sheet is positioned for sliding engagement with an axially opposed second surface of such sponge-like member. The axially opposed second surface of such printing plate carrier sheet being capable of having at least one printing plate adhered thereto. According to the present invention, one of such carrier sheet and such printing plate carrier sheet is engageable adjacent one edge thereof with one of such first and such second surface of the first flat strip-like portion. An opposite one of such carrier sheet and such printing plate carrier sheet is engageable with, adjacent such one edge thereof, one of such first and such second surface of such first flat strip-like portion and such one edge of such one of such carrier sheet and such printing plate carrier sheet. A securing means engageable with such first flat strip-like portion and such one edge of each of such carrier sheet and such printing plate carrier sheet is provided to secure the carrier sheet and the printing plate carrier sheet to such first flat strip-like portion and thereby form such improved compressible-type printing plate composite.

OBJECTS OF THE INVENTION

It is, therefore, one of the primary objects of the present invention to provide an improved compressible-type printing plate composite for a printing plate cylinder which will enable increased line speeds to be used in the printing operation without a sacrifice in print quality.

Another object of the present invention is to provide an improved compressible-type printing plate composite for a printing plate cylinder which will enable poorer quality substrate material to be used in the printing operation without sacrificing print quality.

Still another object of the present invention is to provide an improved compressible-type printing plate composite for a printing plate which will extend the life of such cylinder.

Yet another object of the present invention is to provide an improved compressible-type printing plate composite for a printing plate cylinder which enables the printing plate to be assembled to and removed from such cylinder in less time.

A further object of the present invention is to provide an improved compressible-type printing plate composite for a printing plate cylinder which will substantially minimize board crush during the printing operation.

An additional object of the present invention is to provide an improved compressible-type printing plate composite for a printing plate cylinder which is suitable for use with printing plates consisting of rubber or photopolymer.

Still yet another object of the present invention is to provide an improved compressible-type printing plate composite for a printing plate cylinder which will extend the useful life of the printing plate.

Yet still another object of the present invention is to provide an improved compressible-type printing plate composite for a printing plate cylinder which is capable of printing over low spots present in the substrate material to receive printing thereon.

A still further object of the present invention is to provide an improved compressible-type printing plate composite for a printing plate cylinder which will enable a wide range of impression settings to be used without detrimental effects on either the print quality or board crush occurring.

Yet another object of the present invention is to provide an improved compressible-type printing plate composite for a printing plate cylinder in which less downtime for making adjustments during the printing operation will be required.

It is an additional object of the present invention to provide an improved compressible-type printing plate composite for a printing plate cylinder which will result in fewer rejections of the finished product being required.

In addition to the above-described objects and advantages of the present invention, various other objects and advantages of the improved compressible-type printing plate composite will become more readily apparent to those persons who are skilled in the printing art from the following more detailed description of the invention, particularly, when such description is taken in conjunction with the attached drawings and with the appended claims.

BRIEF DESCRIPTION OF THE PRESENT INVENTION

Figure 1:
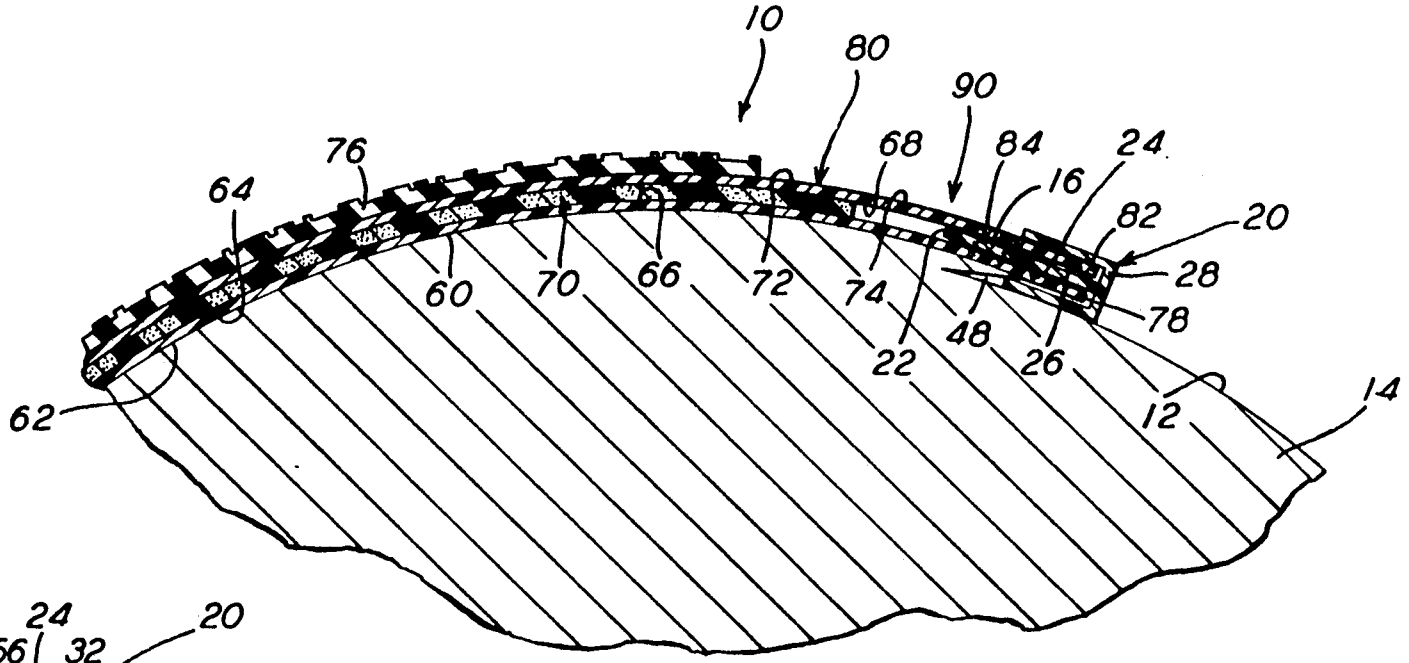
FIG. 1 is a fragment side elevational view, in cross-section, which illustrates one presently preferred embodiment of the compressible-type printing plate composite of the present invention.

Before proceeding to the more detailed description of the improved compressible-type printing plate composite, constructed according to the instant invention, it should be noted that in each of the views illustrated, identical components, which have identical functions, have been identified, for the sake of clarity, with identical reference numerals.

Now reference is made to FIG. 1, wherein one presently preferred embodiment of the improved compressible-type printing plate composite, generally designated 10, constructed according to the present invention is illustrated. This printing plate composite 10 includes both a quick mounting and a quick alignment system incorporated therein. Such mounting and alignment system enables the printing plate composite to be relatively quickly secured in place, in an accurately aligned predetermined position on at least a predetermined portion of a working surface 12 of a printing plate cylinder 14 positioned in at least one print station (not shown) disposed in a printing arrangement (not shown).

The printing plate composite 10 includes an elongated substantially T-shaped member, generally designated 20. Such substantially T-shaped member 20 serves as the quick mounting and quick alignment system in the present invention. The substantially T-shaped member 20 includes a first elongated flat strip-like portion 16. In the presently preferred embodiment of this invention, such first flat strip-like portion 16 will be substantially rectangular in shape. In any event, the first flat strip-like portion 16 has axially opposed first and second edges, designated respectively as 18 and 22, and axially opposed first and second surfaces, designated respectively as 24 and 26, and axially opposed first and second ends (not shown). In addition, this first flat strip-like portion 16 has each of a first predetermined length and a first predetermined width and a first predetermined thickness.

This substantially T-shaped member 20 also includes a second elongated flat strip-like portion 28. Like the first flat strip-like portion 16, such second flat strip-like portion 28 will be substantially rectangular in shape, in the presently preferred embodiment of the invention. The second flat strip-like portion 28 includes axially opposed first and second edges, designated respectively as 30 and 32, and axially opposed first and second surfaces, designated respectively as 34 and 36, and axially opposed first and second ends (not shown). Also, the second flat strip-like portion 28 has a second predetermined length and a second predetermined thickness and a second predetermined width. In the presently preferred embodiment of the invention, the second predetermined length and the second predetermined thickness of such second flat strip-like portion 28 will be substantially the same as the first predetermined length and the first predetermined thickness of such first flat strip-like portion 16. On the other hand, the second predetermined width of the second flat strip-like portion 28 will be substantially narrower than the first predetermined width of such first flat strip-like portion 16. For example, the second flat strip-like portion 28 will have a width equal to between about 0.25 and 0.4 times the width of such first flat strip-like portion 16. This second flat strip-like portion 28 is connected, substantially along an entire length thereof, substantially normal to the first edge 18 of such first flat strip-like portion 16 and substantially midway between the axially opposed first and second edges 30 and 32 on the first surface 34 thereof. Such first flat strip-like portion 16 and such second flat strip-like portion 28 from a T-shaped member when connected in this manner.

The substantially T-shaped member 20 further includes a third elongated strip-like portion 38. In the presently preferred embodiment of the invention, this third flat strip-like portion 38 is also generally rectangular in shape. The third flat strip-like portion 38 has axially opposed first and second edges, designated respectively as 40 and 42, and axially opposed first and second surfaces, designated respectively as 44 and 46, and axially opposed first and second ends (not shown). Additionally, the third flat strip-like portion 38 has a third predetermined length and a third predetermined width and a third predetermined thickness. Preferably, the third predetermined length of such third flat strip-like portion 38 will be substantially identical to the second predetermined length of such second flat strip-like portion 28, and the third predetermined width of such third flat strip-like portion 38 will be between 0.2 and 0.33 times the first predetermined width of such first flat strip-like portion 16, and the third predetermined thickness of such third flat strip-like portion 38 will be equal to or slightly less than the first predetermined thickness of such first flat strip-like portion 16. This third flat strip-like portion 38 is connected, substantially along the entire length of such first edge 40 thereof, to such first edge 30 of such second flat strip-like portion 28. The second edge 42 of such third flat strip-like portion 38 extends toward the second edge 22 of the first flat strip-like portion 16. In addition, the first surface 44 of such third flat strip-like portion 38 is located such that it is substantially parallel to and facing the first surface 24 of such first flat strip-like portion 16.

As is evident in FIG. 1, such third flat strip-like portion 38 forms a first hook-like portion which is engaged with a bar-like member 48 located adjacent the working surface 12 of such printing plate cylinder 14. This bar-like member 48 is disposed substantially parallel to the longitudinal axis of such printing plate cylinder 14 and extends usually across the entire working surface 12.

The final component of such substantially T-shaped member 20 is a fourth elongated flat strip-like portion 50. This fourth flat strip-like portion 50 is also generally rectangular in shape in the presently preferred embodiment of the invention. Such fourth strip-like portion 50 has axially opposed first and second edges, designated respectively as 52 and 54, and axially opposed first and second surfaces designated respectively as 56 and 58, and axially opposed first and second ends (not shown). The fourth predetermined length of such fourth flat strip-like portion 50 is preferably identical to the second predetermined length of such second flat strip-like portion 28 and the fourth predetermined width of such fourth strip-like portion 5 is preferably identical to the third predetermined width of such fourth strip-like portion 38 and also the fourth predetermined thickness of such fourth flat strip-like portion 50 is preferably the same as the third predetermined thickness of such third flat strip-like portion 38. This fourth flat strip-like portion 50 is connected, substantially along the entire length of the first edge 52 thereof, to such second edge 32 of such second flat-like portion 28. The second edge 54 of the fourth strip-like portion 50 extends toward the second edge 22 of such first flat strip-like portion 16. Further, the first surface 56 of this fourth strip-like portion 50 is positioned such that it is substantially parallel to and facing such second surface 26 of the first strip-like portion 16. It is also evident in FIGS. 1 and 2 that this fourth flat-like portion 50 forms a second hook-like portion The first hook-like portion being formed by surface 24, 34 and 44 and the second hook-like portion being formed by surfaces 26, 34 and 56. It is further evident from the above description of FIGS. 1 and 2 that in combination, such first flat strip-like portion 16 and such second strip-like portion 28 and such third strip-like portion 38 and such fourth flat strip-like portion 50 form the substantially T-shaped member 20.

Such printing plate composite 10 further includes a carrier sheet, generally designated 60, which has a predetermined length and a predetermined width and a predetermined thickness. The predetermined length of such carrier sheet 60 is determined by a number of factors These factors include, for example, the diameter of such printing plate cylinder 14 and the size of the printing plate required for a particular job. The predetermined width of such carrier sheet 60 will, in the presently preferred embodiment of the invention, be substantially the same as the predetermined length of the first flat strip-like portion 16. The predetermined thickness of the carrier sheet 60, as will become clear, hereinafter, can vary within a rather narrow range. At least a portion of an outer surface 62 of such carrier sheet 60 is engageable with the working surface 12 of such printing plate cylinder 14. Such carrier sheet 60, in the presently preferred embodiment of the invention, will be made from a polyester material. Such material is presently available as mylar.

The printing plate composite 10 further includes a sponge-like member, generally designated 70. Such sponge-like member 70 has a predetermined length (to be discussed hereinafter) and a predetermined width, which preferably will be substantially identical to the predetermined width of the carrier sheet 60 and a predetermined thickness which will also be discussed hereinafter. A first surface 64 of the sponge-like member 70 is engageable with and secured to an axially opposed inner surface 66 of the carrier sheet 60. Preferably, this sponge-like member 70 will be a cellular polyurethane material.

Such cellular polyurethane material will have a predetermined density within a range of between about 10.0 and 40.0 pounds per cubic foot. Preferably, such density will be between about 20.0 and 30.0 pounds per cubic foot.

In order to provide a printing plate composite 10 having a thickness of between about 0.260 inches and about 0.280 inches, the predetermined thickness of the carrier sheet 60 plus the predetermined thickness of the sponge-like member 70 will be in a range of between about 0.120 and 0.10 inches in the presently preferred embodiment of the invention.

Another essential component of the printing plate composite 10 is a printing plate carrier sheet, generally designated 80, having a predetermined length and a predetermined width and a predetermined thickness. Preferably, the predetermined length of such printing plate carrier sheet 80 will at least be equal to or slightly greater than the predetermined length of such carrier sheet 60. Additionally, the predetermined width of such printing plate carrier sheet 80 will be substantially the same as the predetermined width of such carrier sheet 60. The predetermined thickness of such printing plate carrier sheet 80 will be generally about 0.030 inches. In the presently preferred embodiment of the invention, such printing plate carrier sheet 80 will be made from a vinyl material. A first surface 68 of such printing plate carrier sheet 80 is slidably engageable with an axially opposed second surface 72 of the sponge-like member 70. The axially opposed second surface 74 of such printing plate carrier sheet 80 is capable of having at least one printing plate 76 adhered thereto. One of the carrier sheet 60 and the printing plate carrier sheet 80 being engageable with one of such first surface 24 and such second surface 26 of such first flat strip-like portion 16 adjacent a respective outer edge 78 and 82 thereof. An opposite one of such carrier sheet 60 and such printing plate carrier sheet 80 is engageable adjacent such respective outer edge 78 and 82 with one of the first surface 24 and the second surface 26 of the first flat strip-like portion 16 and such respective outer edge 78 and 82 of such carrier sheet 60 and such printing plate carrier sheet 80. In this embodiment of the invention, such predetermined length of such carrier sheet 60 is greater than the predetermined length of such sponge-like member 70 by a length that is at least equal to a width of such outer edge 78 of the carrier sheet 60. Also, in the presently preferred embodiment of this invention, each of such carrier sheet 60 and the sponge-like member 70 and the printing plate carrier sheet 80 will be substantially rectangular in shape.

Figure 2:
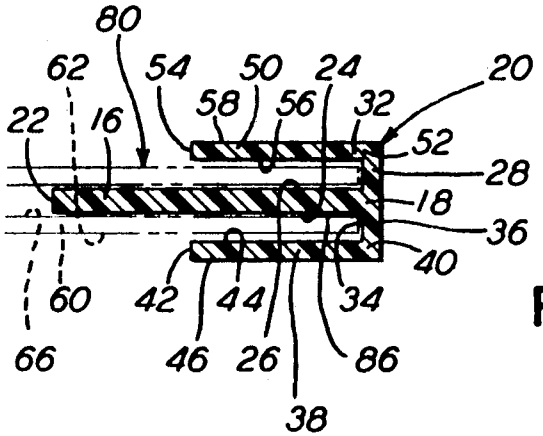
FIG. 2 is an enlarged cross-sectional view, which illustrates the substantially T-shaped member and an alternative securing means of the present invention.

A securing means, generally designated 90, engageable with each of the first flat strip-like portion 16 and such outer edge 78 of the carrier sheet 60 and such one edge 82 of the printing plate carrier sheet 80 is provided to secure the carrier sheet 60 and the printing plate carrier sheet 80 to such first flat strip-like portion 16 and thereby form such improved compressible-type printing plate composite 10. Such securing means 90 can be either stitching 84 (FIG. 1) or an adhesive 86 (FIG. 2). In the most preferred embodiment of the present invention, the outer edge 78 of the carrier sheet 60 is engageable with the first surface 24 of such first flat strip-like portion 16 and the outer edge 82 of such printing plate carrier sheet 80 is engageable with such surface 26 of the first flat strip-like portion 16 and stitched in place.

The printing plate 76 can be made from rubber or photopolymer, but will preferably be a photopolymer material.

It is presently preferred that such substantially T-shaped member 20 be formed integrally as a single piece. This, for example, can be accomplished by extruding plastic into such substantially T-shaped member 20.

If, for example, the carrier sheet 60 is to be held in place on such working surface 12 of the printing plate cylinder 14 by a vacuum, then such carrier sheet 60 must be impervious to the passage of air therethrough.

While a number of presently preferred and alternative embodiments of the improved compressible-type printing plate composite constructed according to the present invention have been described in detail above, various other modifications and adaptations of such invention can be made by persons skilled in the printing plate art without departing from the spirit and scope of the appended claims.

I claim:

1. An improved compressible-type printing plate composite which includes both a quick mounting and a quick alignment system incorporated therein that will enable said printing plate composite to be quickly secured in place on at least a predetermined portion of a working surface of a printing plate cylinder, having a bar-like member positioned in at least one print station disposed in a printing arrangement, in an accurately aligned position, said compressible-type printing plate composite comprising:

(a) an elongated substantially T-shaped member, said elongated substantially T-shaped member including:

(i) a first flat elongated strip-like portion having axially opposed first and second edges and axially opposed first and second surfaces and axially opposed first and second ends, said first flat strip-like portion having a first predetermined length and a first predetermined width and a first predetermined thickness;

(ii) a second elongated flat strip-like portion having axially opposed first and second edges and axially opposed first and second surfaces and axially opposed first and second ends, said second flat strip-like portion being connected substantially along an entire length thereof, substantially normal to said first edge of said first flat strip-like portion substantially midway between said axially opposed first and second edges on said first surface thereof thereby forming a T-shaped member, said second flat strip-like portion having a second predetermined length and a second predetermined width and a second predetermined thickness;

(iii) a third elongated flat strip-like portion having axially opposed first and second edges and axially opposed first and second surfaces and axially opposed first and second ends, said third flat strip-like portion being connected, substantially along an entire length of said first edge thereof, to said first edge of said second flat strip-like portion, with said second edge thereof extending toward said second edge of said first flat strip-like portion, said first surface of said third flat strip-like portion being substantially parallel to and facing said first surface of said first flat strip-like portion, said third flat strip-like portion forming a first hook-like portion for engagement with such bar-like member located adjacent such working surface of such printing plate cylinder and disposed substantially parallel to a longitudinal axis of such a printing plate cylinder, said third flat strip-like portion having a third predetermined length and a third predetermined width and a third predetermined thickness; and (iv) a fourth elongated flat strip-like portion having axially opposed first and second edges and axially opposed first and second surfaces and axially opposed first and second ends, said fourth strip-like member being connected, substantially along an entire length of said first edge thereof, to said second edge of said second flat strip-like portion with said second edge thereof extending toward said second edge of said first flat strip-like portion, said first surface of said fourth flat strip-like portion being substantially parallel to and facing said second surface of said first flat strip-like portion, said fourth flat strip-like portion forming a second hook-like portion, said fourth flat strip-like portion having a fourth predetermined length and a fourth predetermined width and a fourth predetermined thickness, said first flat strip-like portion and said second flat strip-like portion and said third flat strip-like portion and said fourth flat strip-like portion combining to form said substantially T-shaped member;

(b) a carrier sheet having a predetermined length and a predetermined width and a predetermined thickness, said carrier sheet having axially opposed outer surface and inner surfaces, at least a portion of said outer surface of said carrier sheet being engageable with such working surface of such printing plate cylinder;

(c) a sponge-like member having a predetermined length and a predetermined width and a predetermined thickness, a first surface of said sponge-like member being engageable with and secured to said axially opposed inner surface of said carrier sheet;

(d) a printing plate carrier sheet having a predetermined length and a predetermined width and a predetermined thickness, said printing plate carrier sheet having a first surface thereof slidably engageable with an axially opposed second surface of said sponge-like member and an axially opposed second surface capable of having a printing plate adhered thereto, one of said carrier sheet and printing plate carrier sheet being engageable adjacent one edge thereof with one of said first and said second surfaces of said first flat strip-like portion and an opposite one of said carrier sheet and said printing plate carrier sheet being engageable adjacent said one edge thereof with one of said first and said second surface of said first flat strip like portion and said one edge of said one of said carrier sheet and said printing plate carrier sheet; and (e) a securing means engageable with said first flat strip-like portion and said one edge of said carrier sheet and said printing plate carrier sheet for securing said carrier sheet and said printing plate carrier sheet to said first flat strip-like portion thereby forming said improved compressible type printing plate composite.

2. An improved compressible-type printing plate composite, according to claim 1, wherein said sponge-like member is a cellular polyurethane material having a predetermined density.

3. An improved compressible-type printing plate composite, according to claim 2, wherein said carrier sheet is a polyester material.

4. An improved compressible-type printing plate composite, according to claim 3, wherein said predetermined length of said carrier sheet is greater than said predetermined length of said sponge-like member by a length at least equal to a width of said one edge of said carrier sheet.

5. An improved compressible-type printing plate composite, according to claim 4, wherein said predetermined width of said carrier sheet is substantially equal to said predetermined width of said cellular polyurethane material.

6. An improved compressible-type printing plate composite, according to claim 5, wherein said predetermined thickness of said carrier sheet plus said predetermined thickness of said cellular polyurethane material is in a range of between about 0.120 and about 0.10 inches.

7. An improved compressible-type printing plate composite, according to claim 6, wherein said predetermined thickness of said printing plate carrier sheet is about 0.030 inches.

8. An improved compressible-type printing plate composite, according to claim 7, wherein said one edge of said carrier sheet is engageable with said first surface of said first flat strip-like portion and said one edge of said printing plate carrier sheet is engageable with said second surface of said first flat strip-like portion.

9. An improved compressible-type printing plate composite, according to claim 1, wherein said securing means is one of stitching and adhesive.

10. An improved compressible-type printing plate composite, according to claim 9, wherein said securing means is stitching.

11. An improved compressible-type printing plate composite, according to claim 8, wherein said one edge of said carrier sheet and said one edge of said printing plate carrier sheet are secured, respectively, to said first surface and said second surface of said first flat strip-like member by stitching.

12. An improved compressible-type printing plate composite, according to claim 8, wherein said printing plate carrier is vinyl.

13. An improved compressible-type printing plate composite, according to claim 12, wherein said improved printing plate composite further includes a printing plate secured to said second surface of said printing plate carrier sheet.

14. An improved compressible-type printing plate composite, according to claim 13, wherein said printing plate is one of rubber and photopolymer.

15. An improved compressible-type printing plate composite, according to claim 14, wherein said printing plate is photopolymer.

16. An improved compressible-type printing plate composite, according to claim 14, wherein said printing plate composite has a thickness of between about 0.260 and about 0.280 inches.

17. An improved compressible-type printing plate composite, according to claim 1, wherein said predetermined width of said third flat strip-like portion is substantially equal to said predetermined width of said fourth flat strip-like portion.

18. An improved compressible-type printing plate composite, according to claim 17, wherein said predetermined length of each of said first flat strip-like portion and said second flat strip-like portion and said third flat strip-like portion and said fourth flat strip-like portion is substantially identical.

19. An improved compressible-type printing plate composite, according to claim 18, wherein said predetermined thickness of each of said first flat strip-like portion and said second flat strip-like portion and said third flat strip-like portion and said fourth flat strip-like portion is substantially identical.

20. An improved compressible-type printing plate composite, according to claim 19, wherein said first flat strip-like portion and said second flat strip-like portion and said third flat strip-like portion and said fourth flat strip-like portion are formed integrally as a single piece.

21. An improved compressible-type printing plate composite, according to claim 20, wherein said single piece is extruded plastic.

22. An improved compressible-type printing plate composite, according to claim 21, wherein each of said first flat strip-like portion and said second flat strip-like portion and said third flat strip-like portion and said fourth flat strip-like portion is substantially rectangular in shape.

23. An improved compressible-type printing plate composite, according to claim 1, wherein each of said carrier sheet and said sponge-like member and said printing plate carrier sheet is rectangular in shape.

24. An improved compressible-type printing plate composite, according to claim 1, wherein said carrier sheet is held in place on such working surface of such printing plate cylinder by a vacuum and said carrier sheet is impervious to passage of air therethrough.

* * * * *

UNITED STATES PATENT AND TRADEMARK OFFICE

CERTIFICATE OF CORRECTION

PATENT NO. : 5,092,238

DATED : March 3, 1992

INVENTOR(S) : Ivan N. Philpot

It is certified that error appears in the above-identified patent and that said Letters Patent is hereby corrected as shown below:

Column 7, line 9, delete "5", and insert --50--.

Signed and Sealed this

First Day of June, 1993

Michael K. Kirk

MICHAEL K. KIRK

*Acting Commissioner of Patents and Trademarks*

*Attest:*

*Attesting Officer*